United States Patent [19]

Pilborough

[11] Patent Number: 4,666,185

[45] Date of Patent: May 19, 1987

[54] LABELS

[75] Inventor: Frank Pilborough, Boston, England

[73] Assignee: Norcros Investments Limited, Bershire, England

[21] Appl. No.: 579,688

[22] Filed: Feb. 13, 1984

[30] Foreign Application Priority Data

Dec. 14, 1983 [GB] United Kingdom ..... 8333282

[51] Int. Cl.[4] ..... B42D 15/00; G09F 3/00

[52] U.S. Cl. ..... 283/80; 283/81; 40/2 R

[58] Field of Search ..... 283/80, 81; 40/2 R, 40/615; 428/40

[56] References Cited

U.S. PATENT DOCUMENTS

| | | | |
|---|---|---|---|
| 3,228,129 | 1/1966 | Gwinn et al. | 283/80 |
| 4,065,343 | 12/1977 | Stumpe | 40/2 R |
| 4,128,954 | 12/1978 | White | 283/81 |
| 4,276,334 | 6/1981 | Sugihara | 283/81 |
| 4,277,902 | 7/1981 | Miniaci et al. . | |
| 4,312,523 | 1/1982 | Haines | 283/81 |
| 4,390,577 | 6/1983 | Brister et al. | 40/2 R |
| 4,457,539 | 7/1984 | Hamisch | 283/80 |

FOREIGN PATENT DOCUMENTS

| | | |
|---|---|---|
| 2158748 | 5/1973 | Fed. Rep. of Germany . |
| 2442711.0 | 3/1976 | Fed. Rep. of Germany . |
| 7541517 | 5/1976 | Fed. Rep. of Germany . |
| 969149 | 9/1964 | United Kingdom . |
| 1068891 | 5/1967 | United Kingdom . |
| 1107960 | 3/1968 | United Kingdom . |
| 1169200 | 10/1969 | United Kingdom . |
| 1519879 | 8/1978 | United Kingdom . |
| 2067161 | 3/1983 | United Kingdom . |

*Primary Examiner*—Paul A. Bell
*Assistant Examiner*—Paul M. Heyrana, Sr.
*Attorney, Agent, or Firm*—Leydig, Voit & Mayer

[57] ABSTRACT

An identification label comprising a first, loop, portion having a first layer of pressure-sensitive adhesive on one part thereof, the portion being adapted to form a loop by adherence of the first layer to another part thereof after passing through a part of an item to be identified, a second, check, portion having dimensions less than those of the first portion but completely covering the first layer of adhesive and having a second layer of adhesive, the second layer serving to bond preferentially a piece of paper or other laminar material which produces visible markings when subjected to printing or other pressure so that when the first portion is printed or otherwise provided with visible indicia, the check portion will exhibit a copy of this indicia, in use, the two portions being used separately to provide identical information provided by said indicia.

4 Claims, 3 Drawing Figures

LABELS

This invention relates to identification labels for use, for example, as destination labels and purposes ancillary thereto in connection with airline and other travel services. The invention also relates to a band of such labels.

British Patent Specification No. 2,067,161 discloses an identification label which incorporates a loop portion intended to be looped around the handle of an item of baggage, a second portion initially adhesively attached to the loop portion and intended finally to be attached to a travel or other document and in some embodiments, a third portion forming a part detachable from the loop portion or from the second portion and which serves a security purpose in as far as it will be adhesively directly attached to the item of baggage carrying the loop portion.

The label described and claimed in this prior specification has the important advantage over other, previously proposed, labels that multiple purposes are served without, in use, the generation of any waste or scrap material. It follows that at airline check-in locations tidiness is maintained at all times even when the staff are under particularly heavy pressure. However, this previously proposed label does not satisfy every requirement of present day airline practice.

According to the present invention there is provided an identification label comprising a first, loop, portion having a first layer of pressure-sensitive adhesive on one portion thereof, the portion being adapted to form a loop by adherence to another portion thereof after passing through a part of an item to be identified, a second, check, portion having dimensions less than those of the first portion but completely covering the said layer of adhesive and having a second layer of adhesive, the second layer serving to bond preferentially a piece of paper or other laminar material which produces visible markings when subjected to printing or other pressure so that when the first portion is printed or otherwise provided with visible indicia, the check portion will exhibit a copy of this indicia, in use, the two portions being used separately to provide identical information provided by said indicia.

Further according to the present invention there is provided an elongate identification label comprising a first, loop, portion having a first layer of pressure-sensitive adhesive covering one end portion thereof, the loop portion being adapted to form a loop by causing the adhesive coated end portion to adhere to the other end portion after the loop portion has passed through closed configuration means of an item of baggage or other item to be identified, a second, check, portion having a second layer of adhesive, said check portion at least covering the whole of said first layer and having on the face coated with said second layer a piece of paper or other laminar material with the property of producing visible indicia when pressure is applied thereto, said piece at least covering the said second layer of adhesive and having in relation to the first layer a higher adhesive power so that said piece is preferentially retained by the second adhesive layer and said piece being coated on the face contacting the first layer with a silicone or other release agent.

The invention will now be described, by way of example only, with reference to the accompanying drawing, in which.

Figure 1:
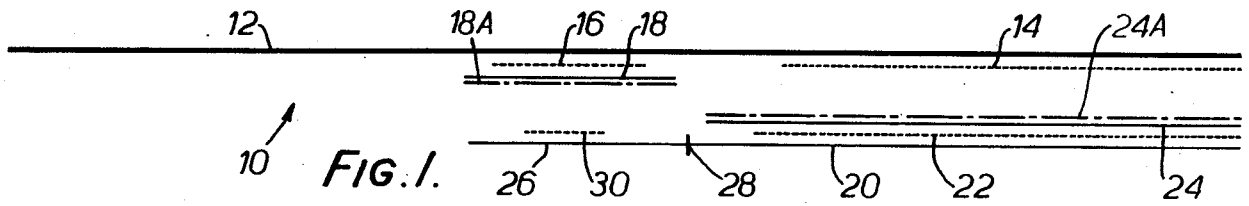
FIG. 1 is a side view of an identification label in accordance with the invention showing the layers thereof spaced from one another for the sake of clarity.

Referring now to the drawing, the label 10 illustrated is intended for airline use, but can be used for any other form of travel or indeed other identification purpose. The label meets the requirement that information peculiar to a specific flight or even a specific passenger is automatically copied from one portion to another.

A loop, or first, portion 12 is of elongate form and is preferably made of very high strength conventional paper or "paper" or laminate based on plastics materials. The reason for this is the possibility that in use when looped around the handle of an item of baggage or other closed means of an item to be identified attempts may be made to move the whole item by means of the label rather than the associated handle. The high strength also resists generally the rigours of human and mechanical handling.

On the undersurface of this first portion about one-third of the overall length has a layer 14 (first layer) of suitably developed pressure-sensitive adhesive which extends to one end of the label 10. A further, bonding, adhesive layer 16 (third layer) spaced from this first layer of pressure-sensitive adhesive is of a more permanent nature or alternatively is of the same quality as the first layer, but is arranged to cooperate with a piece of release paper 18 coated only on one side with a release agent or substance 18A such as a silicone so that the adherance is increased to an extent that effectively a bond is produced. This piece 18 has a lengthwise extent in both directions somewhat greater than the second layer 16 itself since it is important that manufacturing tolerances should not permit the more permanent adhesive layer 16 to become effective in relation to other parts of the label.

A second portion 20 (baggage check portion) of the label comprises a natural or synthetic paper although the requirements for extremely high strength are less onerous as the duties of this portion are themselves less demanding. This portion has a more permanent layer of adhesive 22 (second layer) which, in the preferred embodiment, has an extent from the right hand end, as shown, slightly greater than the first-mentioned adhesive layer 14 of the loop portion 12 of the label 10. The adhesive layer 22 of the baggage check portion has permanently adhered to it a length 24 of copy paper known per se which incorporates a chemical which changes colour when pressure, such as printing pressure, is applied so that indicia can be produced.

The copy paper also has a coating of release agent 24A on the face thereof directed towards the loop portion 12.

An optional end portion 26 of the baggage check portion is separated by perforations 28 and is of comparatively small length. It has a layer (fourth layer) of suitably developed pressure-sensitive adhesive 30 which lies opposite, in the assembled condition, the layer 18 of release paper which is permanently bonded to the main portion 12 of the identification label by the adhesive layer 16. The adhesive of this minor portion of the baggage check portion does not extend to the free edge because the edge portion free of adhesive enables ready detachment of the baggage check portion as a whole. The portion 26 is, in use, folded back to enable portion 20 with the duplicated information on the copy layer 24 to be adhered to an airline passenger ticket or other document.

Figure 2:
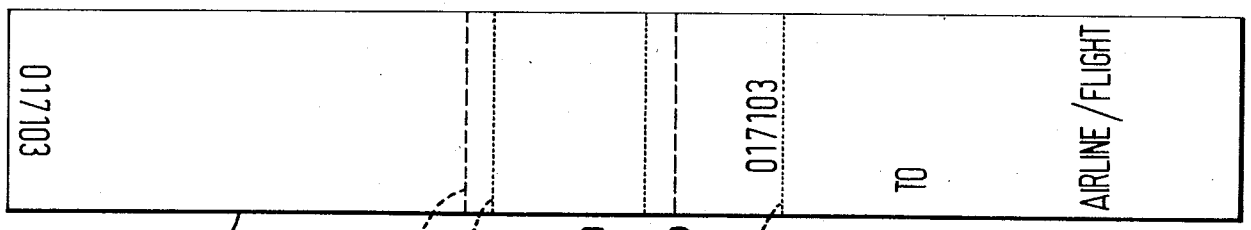
FIG. 2 is a plan view of a first, loop, portion of the label.
Figure 2A:
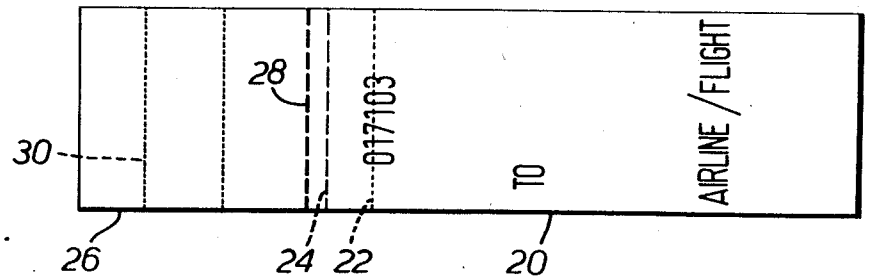
FIG. 2A is a plan view of a second, check, portion of the label.

FIGS. 2 and 2A enable a ready understanding of the manner of operation of the label described in detail with reference to FIG. 1. The main portion 12 extending from the left-hand group of numbers to the right hand group of numbers can carry various items of variable information such as identification, destination and so on. At the check-in location at an airport the airline flight number will be written in at the appropriate location at the right-hand end of the main portion and this will be duplicated by the provision of the automatic copy paper length 24 of the baggage check portion. The latter can be attached to the passenger's ticket by the adhesive layer 30 of the perforated portion 26 when bent back through 180°.

In an unillustrated modification, the labels are initially part of a band of labels with individual labels extending transversely of the length of the band and interconnected by lines of perforations. In this modification there may be pre-printing of certain information on the loop portion of the label or alternatively there may be no pre-printing so that the total information is printed at the time of issue of the ticket by a local dot-matrix or other computer-controlled printer, the number of labels being limited to the requirements of a particular flight and destination. The line of perforations 28 may be omitted on this modification.

The band will have holes along both longitudinal edges so as to enable passage through the computer-controlled printer. These edge portions will be formed in additional portions of the labels, considered individually. The modifications enable normal requirements to keep a stock of pre-printed labels to be completely eliminated. Furthermore, with increasing use of computerized printing, the flight documents can be printed on the basis of the same information as required for the labels.

In a further, unillustrated modification the pressure sensitive adhesive layer 30 is extended so that it spans the line of perforations 28 and the layer 22 is correspondingly reduced in length together with the layer of copy paper 24. By this modification together with appropriate changes in the information given on the portion 26, the latter can be detached and used as a secondary identification on the item of baggage (or other article). The extended layer 30 will enable the portion 20 of the label to be adhered to a passenger ticket as before.

The paper or other laminar material used for both portions of the label may be of various available papers and synthetic papers and may also be laminated for additional strength.

Labels in accordance with the hereinbefore described preferred embodiment and modifications are believed to have the following advantages:

(1) A single application of pressure provides duplicate indicia;

(2) No waste at time of use despite provision of two and optionally three identification sources for a single basic label;

(3) The basic label can readily be adapted for dot-matrix or other computer controlled printing.

(4) The basic label can be manufactured in band form and then rolled or fan-folded, individual labels being detachable at the point of use;

(5) By matching the strength of adherence/bonding between portions of the label it can be ensured that the manner of use will always be correct.

I claim:

1. An elongate identification label comprising a first, elongate, loop, portion having a first end part, a second end part, a first layer of pressure-sensitive adhesive covering said first end part of the first portion, the loop portion being adapted to form a loop by causing the adhesive-coated first end part to adhere to the second end part after the loop portion has passed through closed configuration means of an item to be identified, a second, check, portion having a face thereof coated with second layer of adhesive, said check portion covering an area in excess, lengthwise, of the whole of said first layer of adhesive on the loop portion and being adhered thereto and having a piece of laminar material adhered to the said face coated with said second layer, with the property of producing visible indicia when pressure is applied thereto, said piece covering an area in excess, lengthwise, of the area of the said second layer of adhesive and having in relation to the first layer of adhesive a higher adhesive power so that said piece is preferentially retained by the second adhesive layer and said piece being coated on the face contacting the first layer with a release-agent.

2. A label according to claim 1, wherein the loop portion has a third adhesive layer spaced from the first layer and a piece of release-agent coated laminar material covering the third adhesive layer and wherein the check portion has a fourth, pressure-sensitive, adhesive layer spaced from the second layer and having an area less than but lying opposite to said release-agent coated piece, covering the third adhesive layer of laminar material, the latter adhering preferentially to the said third layer so that, at the point of use, detachment of the check portion from the loop portion will result in one said adhesive layer becoming exposed on each portion of the label.

3. A label according to claim 2, wherein the fourth adhesive layer is provided on a part of the check portion which is separated from another part of the check portion by perforations.

4. An elongate identification label comprising a first, elongate, loop portion having a first end part, a second end part, a first layer of pressure-sensitive adhesive covering said first end part of the loop portion, a further layer of pressure-sensitive adhesive covering an intermediate part thereof and spaced from the first layer, and a piece of release-agent coated laminar material preferentially adhering to the said further layer and having a length in excess of the length of the further layer and a check portion overlying and adhered to the first and further adhesive layers and itself having a second pressure-sensitive adhesive layer lying substantially opposite the first layer but spaced from the further or third layer of adhesive, a second piece of release-agent coated laminar material preferentially adhering to the second adhesive layer, adhered to the first adhesive layer and covering an area in excess of the area of that layer and having the property of producing indicia on the check portion when pressure is applied thereto, and a fourth pressure-sensitive adhesive layer of smaller area than and in contact with the first piece of release-agent coated laminar material, the arrangement being such that the application of pressure to that part of the loop portion lying opposite the second piece of laminar material will produce duplicate indicia on the check portion and thereafter separation of the two portions enables the loop portion to be looped around an item to be identified and the check portion to be adhered to an item by means of the fourth layer of pressure-sensitive adhesive.

* * * * *